US007516796B2

(12) United States Patent
Bertane

(10) Patent No.: US 7,516,796 B2
(45) Date of Patent: Apr. 14, 2009

(54) PISTON PUMP ASSEMBLY WITH FLEXIBLE RISER PIPE

(75) Inventor: Mark Bertane, Glen Ellyn, IL (US)

(73) Assignee: Blackhawk Environmental Co., Glen Ellyn, IL (US)

( * ) Notice: Subject to any disclaimer, the term of this patent is extended or adjusted under 35 U.S.C. 154(b) by 99 days.

(21) Appl. No.: 11/650,911

(22) Filed: Jan. 5, 2007

(65) Prior Publication Data

US 2008/0164032 A1 Jul. 10, 2008

(51) Int. Cl.
*E21B 43/16* (2006.01)

(52) U.S. Cl. ..... 166/370; 166/68.5; 166/105

(58) Field of Classification Search ..... 166/68.5, 166/105, 369, 370
See application file for complete search history.

(56) References Cited

U.S. PATENT DOCUMENTS 3,212,582 A * 10/1965 Brown ..... 166/242.2
3,225,697 A * 12/1965 Brown ..... 417/20
3,234,723 A * 2/1966 Brown ..... 57/222
4,024,913 A * 5/1977 Grable ..... 166/72
4,641,707 A * 2/1987 Akkerman ..... 166/116
5,257,850 A * 11/1993 Brim ..... 296/39.2
5,429,193 A 7/1995 Hegebarth et al.
6,640,896 B1 * 11/2003 Zheng ..... 166/250.15

* cited by examiner

*Primary Examiner*—Hoang Dang
(74) *Attorney, Agent, or Firm*—Marshall, Gerstein & Borun LLP

(57) ABSTRACT

A pump for pumping liquid from a well having a continuous flexible riser pipe that does not have a coil memory and a flexible actuating rod disposed within the flexible riser pipe. A piston valve unit is disposed at one end of the riser pipe and drivably connected to the actuating, the piston valve unit having an outer diameter that is greater than the inner diameter of the continuous riser pipe.

19 Claims, 5 Drawing Sheets

PISTON PUMP ASSEMBLY WITH FLEXIBLE RISER PIPE

TECHNICAL FIELD

The present disclosure relates generally to a pumping assembly with a flexible riser and specifically to a top head drive piston pump that utilizes a continuous riser made of a flexible material that has little or no coil memory.

BACKGROUND OF THE DISCLOSURE

Piston pumps are currently used in wells of all sorts. For example, oil, water, landfill leachate, petrochemical spill, tank farm recovery, pipe line spill and other types of general environmental pumps. Known piston pumps generally utilize a rigid riser pipe (e.g., steel pipe or plastic pipe), having a plurality of sections of manageable lengths, generally 10-20 feet in length. The rigid pipe is installed by repeatedly blocking and lowering the rigid riser pipe, section by section. Each successive pipe section is attached to the previous section via adhesives, or screw fittings and joints. Such an operation is very time consuming and manpower intensive. Similarly, when a down well component needs to be raised for maintenance or replacement, the installation process is reversed, whereby each section must be blocked and lifted out of the well, disconnecting each rigid pipe section as it is removed.

After the rigid riser pipe is in place down the well bore, a rigid actuating rod is inserted by section through the riser pipe in a similar manner. That is, blocking and lowering of the rigid actuating rod, section by section, is required until the full length of the actuating rod is inserted into the rigid riser pipe.

Eventually, flexible actuating rods were developed to be extended through the rigid riser pipe to the bottom of the well for driving a pump piston in the rigid riser pipe which, in turn, pumps liquid back up the rigid riser and out of the well. One example of such a flexible actuating rod-driven pump assembly is shown in U.S. Pat. No. 5,429,193, owned by the assignee of the present application, the entire subject matter of which patent is hereby incorporated by reference. The unitary flexible actuating rod disclosed there allows the piston to be installed in and removed from the riser pipe more quickly. Additionally, the flexible actuating rod occupies less space when stored.

Because the pump piston was inserted and removed through the rigid riser pipe after installation of the riser pipe, the piston was limited in outer diameter to the smallest inner diameter present in the rigid riser pipe. This, in turn, limited the maximum flow rate of this type of pump, for example, to around 5 gallons per minute with a typical one inch diameter riser pipe. This limited maximum flow rate often caused low flow velocities and thus allowed silt and sand to accumulate above the piston. This unwanted buildup, in turn, caused premature failure of the pump assembly and/or more frequent maintenance to clean the sand/silt buildups.

Additionally, prior art pump assemblies using rigid riser pipes often suffer from loose riser pipe sections within the well during installation due to incorrect or insufficient attachment between sections of the rigid riser pipe. Often, the material of the rigid riser pipe was incompatible chemically with the liquid being pumped in the desired application. Further, wrong size pipes (diameters or lengths) were often chosen for a particular application and the problem was not discovered until the pump assembly was on the job site.

SUMMARY OF THE DISCLOSURE

A pumping assembly for elevating liquid through a well is described herein; the pumping assembly has a riser for channeling liquid, a discharge for removal of liquid from the riser, a piston for elevating liquid toward the discharge and an actuating rod. The actuating rod is formed of a flexible material enabling it to be coiled prior to installation; a piston valve unit is disposed at a lower end of the riser and drivably connected to the actuating rod. A stationary valve unit is disposed at the lower end of the riser adjacent to the piston valve unit and operable to remain in a substantially fixed position relative to the riser device during movement of the piston valve unit. The riser is a continuous flexible pipe formed of a material capable of being coiled prior to installation, and then when installed in an elongated generally vertical orientation, the riser is capable of forming an essentially straight section, the material having essentially no coil memory so as to substantially avoid any sliding wear caused by the up and down movement of the unitary actuating rod within the riser. The piston valve unit has a diameter that is greater than the diameter of the continuous riser. The entire assembly of continuous riser, interfitted flexible actuating rod, and attached piston valve unit can all be lowered into and raised from the well as one unit.

DETAILED DESCRIPTION

Figure 1A:
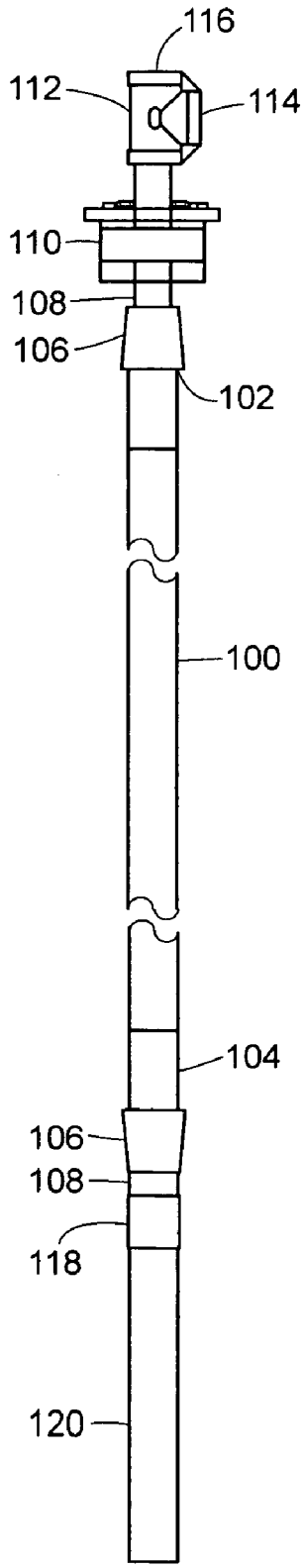
FIG. 1A is a side elevational view of a top head drive piston pump with a unitary flexible riser according to the teachings of the disclosure.

As shown in FIG. 1A, a hollow continuous casing or riser 100 for channeling liquid is inserted into a well bore. The riser 100 includes a first, lower end 104, a second, upper end 102, and a hollow interior (see FIG. 2) that defines a flow channel. In this example, the continuous riser 100 is manufactured from HDPE material, has an inner diameter of approximately 1.5", and may be of virtually any length for insertion into a variety of well depths. The HDPE material riser is lightweight and relatively flexible and may be coiled for storage and then transportation to a well site. Additionally, the HDPE riser does not have a coil memory, even after a substantial duration of storage in coiled form. In other words, when finally uncoiled and inserted into the well, the HDPE material riser becomes substantially straight and does not have a tendency to bend towards and return to its coiled shape. This is unlike the continuous pipes made from other non-HDPE materials that have a coil memory and hence will tend to bend. Thus, although an HDPE material is preferred, the riser 100 may be manufactured from any continuous flexible tube material that does not have a coil memory when uncoiled.

Near the second or upper end 102 of the continuous riser 100, is a reducer coupling 106 which reduces the diameter of the flow chamber from approximately 1.5" to approximately 1.25" in this example. Of course other inner diameters of riser 100 and coupling 106 are possible and are determined by the user such as based on site characteristics and desired flow rates. The reducer coupling 106 joins the riser pipe 100 to a nipple 108 having an inner diameter of approximately 1.25" in this example. The nipple 108 passes through a well seal 110 which may vary in size based upon the diameter of the well bore and the nipple 108. A tee fitting 112 is attached to a free end of the nipple 108 to provide a fluid exit 114 and a connection 116 for a pump motor (not shown).

Near the first or lower end 104 of the riser 100, another reducer 106 is attached to reduce the flow chamber from approximately 1.5" to approximately 1.25" in this example. Another nipple 108 connects the reducer 106 to a coupling 118. The coupling 118, in turn joins the flow channel to the valve assembly 120 by connecting the valve assembly 120 to the second, lower end 104 of the riser. The valve assembly 120 includes a piston 230 (see FIG. 2), which moves a liquid up the flow channel and eventually out the fluid exit 114.

A significant advantage of a pump having a riser pipe made of a continuous flexible material is that the valve assembly 120 may be attached to the riser pipe 100 before insertion into the well bore. This then allows shipment of the coiled continuous riser 100, coiled flexible actuating rod 232, and pump 234 (FIG. 2), to be done together on one or two related pallets to the job site. Then they can be readily connected and interfitted as one pump assembly, with all the needed parts present and at hand, and that pump assembly then extended down the well bore as one interfitted unit. Likewise, when the valve assembly needs maintenance or replacement, the continuous riser pipe 100 may be removed from the well bore with the valve assembly still attached. Importantly, by using a continuous HDPE coil memory free riser with attached pump, unlike the rigid risers of the prior art, the outer diameter of the valve assembly 120 is no longer dependent on the inner diameter of the riser pipe. Contrary to the prior art, this feature allows use of a valve assembly 120 having a larger outer diameter than the inner diameter of the riser pipe 100. This, in turn, means that much greater pump volumes/velocities are possible than with prior art pump systems. Such alternate embodiments will be discussed further hereinafter with reference to FIGS. 3 and 4.

Figure 1B:
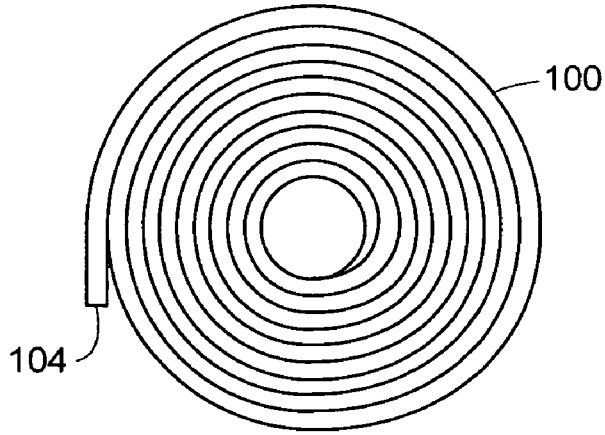
FIG. 1B is a side view of the flexible riser of FIG. 1A in a coiled configuration.

Other advantages are realized by using a continuous riser pipe made from a flexible material. For example, such a flexible riser pipe may be pre-coiled for warehousing, shipment and delivery to the eventual job site. A coiled section of HDPE riser pipe 100 is shown in FIG. 1B. The coiled section of HDPE riser pipe is space efficient in storage and transport. Furthermore, the flexible riser pipe is lighter than comparable rigid riser pipes made from metal, and thus easier to handle, easier to install and remove, with less installation and maintenance labor involved, and can use manual or drum removal. In addition to being lighter weight, and space efficient, the flexible riser pipe is faster to install and can be uninstalled in a single pull as opposed to rigid riser pipes which must be installed and uninstalled via blocking and lowering successive sections of rigid riser pipe and connecting the sections with one another. The flexible riser pipe also makes installation of the pump assembly much cleaner, as there is no need to attach multiple sections with one another via hardware or adhesives.

Figure 1C:
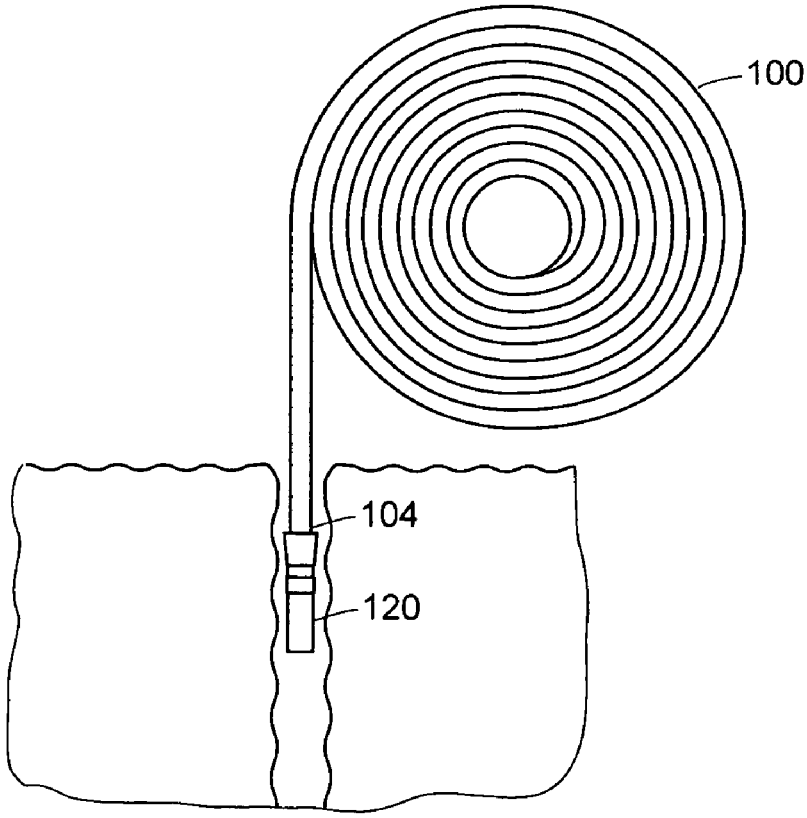
FIG. 1C is a side view of the flexible riser of FIG. 1A being inserted into a well bore.

FIG. 1C shows a partially coiled continuous riser pipe 100 being inserted into a well. Advantageously, the coiled riser pipe 100 is light enough to be installed by a single installer in the field. The coiled riser pipe 100 may by pre-fitted with an actuating rod 232 (see FIG. 2) and a valve assembly 120, and then transported to a well site as a unitary pipe and valve assembly, thus avoiding assembly in the field prior to installation. This provides a significant cost reduction.

Figure 2:
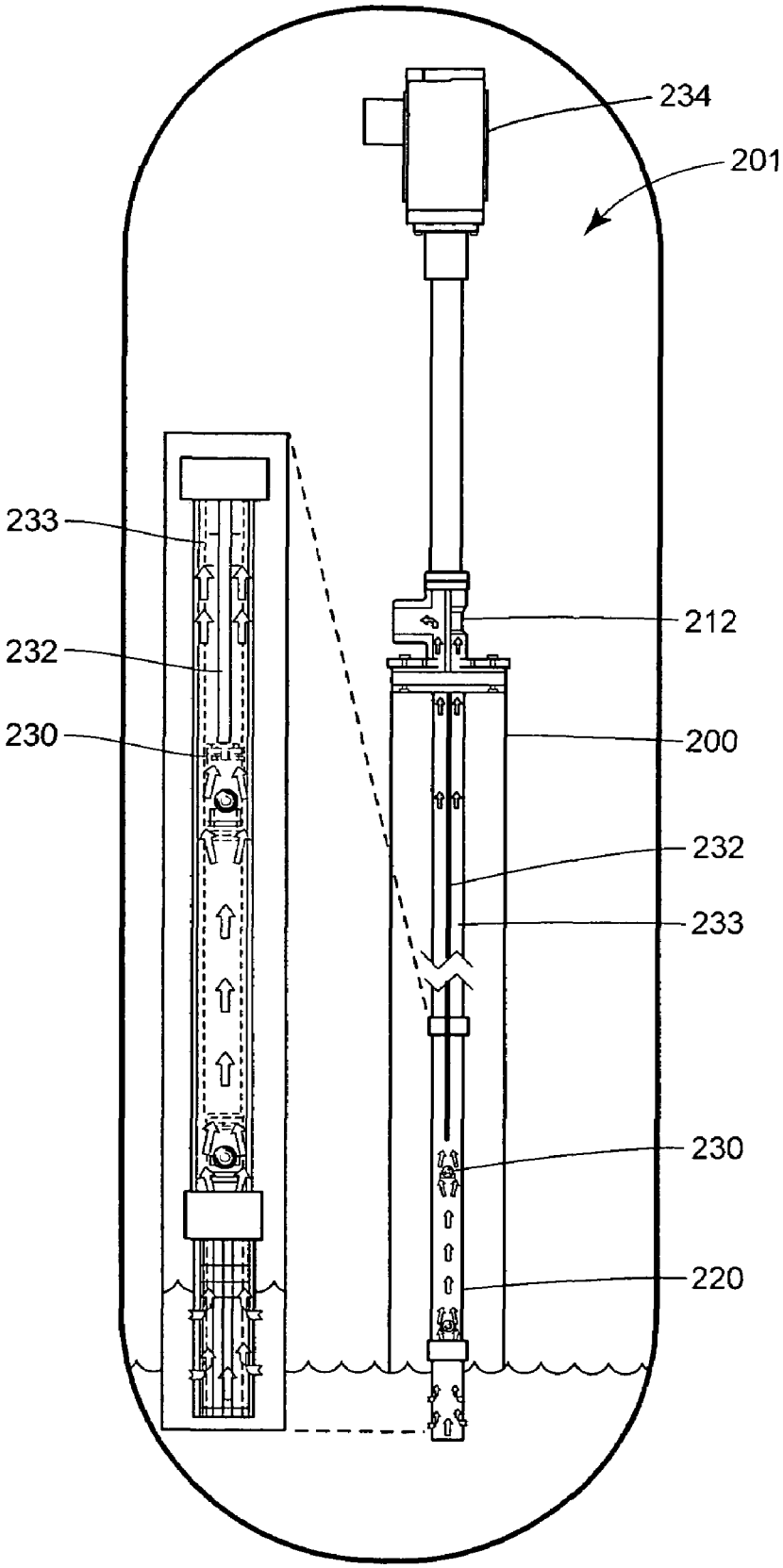
FIG. 2 is a side cutaway view of the pump of FIG. 1.

FIG. 2 shows pump system 201 similar to the pump system of FIG. 1 installed in well bore. The pump system 201 includes a riser pipe 200 and a valve assembly 220 attached to one end of the riser pipe 200. The valve assembly 220 includes a piston 230 connected to a flexible drive rod 232. The flexible drive rod 232 extends through the flow chamber 233 to a motor 234 which moves the piston 230 in a reciprocating normally up and down motion through the flow chamber 233 thereby pumping liquid in a direction from the valve assembly 220 towards the motor 234. The motor 234 is attached to the drive rod 232 and the tee fitting 212 after the riser pipe 200 is inserted into the well bore. Because both the riser pipe 200 and the drive rod 232 are flexible, and continuous, the drive rod 232 may be interfitted with the riser pipe before transport to the job site, or the drive rod 232 and riser pipe 200 may even be interfitted and sold as a unit from the manufacturer. Additionally, shorter free end adaptor sections of both the drive rod 232 and riser pipe 200 may be used to connect with various lengths of sections of riser pipe 200 and drive rod 232, all to produce a desired overall length of drive rod 232 and riser pipe 200 for meeting the final required length in a given installation.

Furthermore, the valve assembly 220 may be attached to the riser pipe 200 before transport to the job site, or at the manufacturing location. Thus, the riser pipe 200, valve assembly 220 and drive rod 232 may be preassembled, and pre-coiled, and thus sold as a ready-to-uncoil and install package. This system is ready for installation without any further assembly at the job site, with the exception of attaching the motor after the system is inserted into the well bore, or the possible need for a final in-the-field cutting adjustment of the upper ends of the riser pipe 200 and drive rod 232, i.e., to adjust the length to place the attached valve assembly 220 at the proper depth in the well bore for the given application. Because of the preassembly and light weight, and ease of coiling and uncoiling, only a single installer (i.e., one person) is required to install the pump in a well bore. This results in considerable cost savings by lowering labor cost through reduction in required personnel and reduced time.

Figure 3:
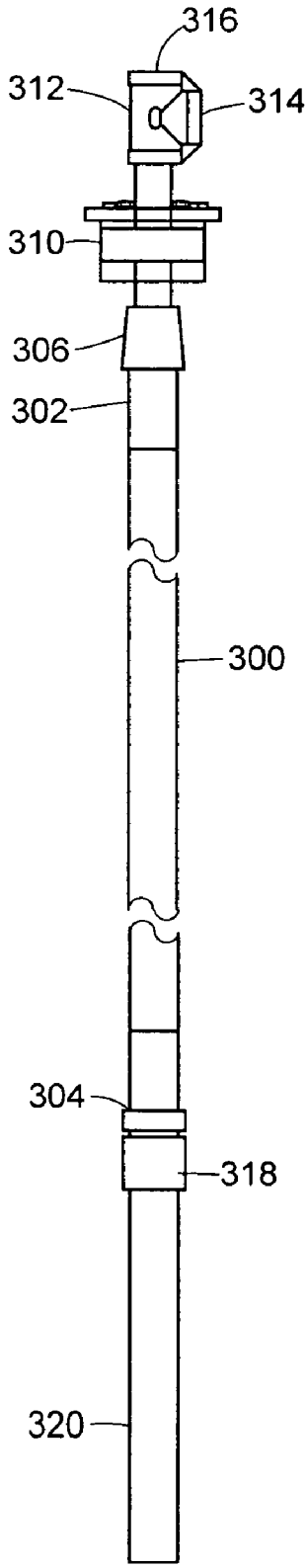
FIG. 3 is a side elevational view of another embodiment of a top head drive piston pump according to the teachings of the disclosure.

FIG. 3 shows a pump system similar to the pump system of FIG. 1A, except that the outer diameter of the valve assembly 320 is larger than the inner diameter of the riser pipe 300. In this example, the diameter of the valve assembly is approximately 2", while the diameter of the riser pipe is approximately 1.5". But unlike with the prior art, this difference in diameter does not matter, as the valve assembly 320 never needs to be pulled up through the riser pipe 300. Further, this increased valve assembly diameter allows a greater volume of liquid to be pumped through the riser pipe for a given riser pipe diameter.

Figure 4:
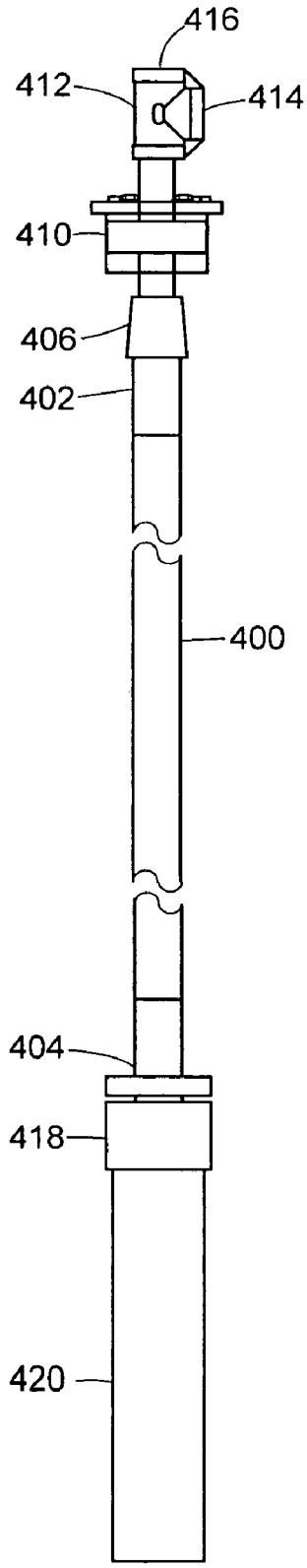
FIG. 4 is a side elevational view of yet another embodiment of a top head drive piston pump according to the teachings of the disclosure.

FIG. 4 shows a pump system similar to the pump systems of FIG. 1A and FIG. 3, except that the diameter of the valve assembly 320 in this example is approximately 3", while the diameter of the riser pipe is approximately 1.5". Once again, this larger diameter valve assembly allows yet a greater volume of liquid to be pumped through the flow channel for a given riser pipe diameter.

While a 1.5" diameter for the continuous, coil memory free riser pipe has been used in the above examples, virtually any size of such riser pipe could be used in the pump systems disclosed above. Additionally, virtually any size valve assembly could be attached to the riser pipe in the above examples.

The present improved pump system is capable of pumping up to approximately 17 gallons per minute, resulting in as much as a 12 gallon per minute improvement over known top head drive piston pump systems. Typical improvements of pump systems formed in accordance with the present disclosure produce flow rates from approximately 0.1 gpm to approximately 10 gpm.

The outer diameter of the valve assembly may be up to approximately 144% larger than the inner diameter of the riser pipe in these examples. This ratio results in approximately a 10% to a 570% increase in liquid discharge rate over the peak liquid discharge through the pump foot valve cylinder, depending on the exact ratio of valve assembly diameter to the riser pipe diameter.

Preferred embodiments of the above described systems generally included a 1" inner diameter riser pipe and a valve assembly outer diameter in the range of approximately 1" to approximately 3". While other configurations are possible, valve assembly outer diameters less than approximately 4" are generally easily removable from the well bore for maintenance or replacement.

While the riser pipes of the disclosed embodiments are generally manufactured from HDPE, the riser pipes can, alternatively, be constructed as a continuous unit from virtually any flexible material that does not have a coil memory.

Although certain pump assemblies have been described herein in accordance with the teachings of the present disclosure, the scope of the appended claims is not limited thereto. On the contrary, the claims cover all embodiments of the teachings of this disclosure that fairly fall within the scope of permissible equivalents.

What is claimed is:

1. A pumping assembly for elevating liquid through a well having a riser for channeling liquid, a discharge device for removal of liquid from the riser, a piston device for elevating liquid toward the discharge device and including an actuating rod, the actuating rod formed of a flexible material enabling it to be coiled prior to installation, a piston valve unit disposed at a first end of the riser and drivably connected to the actuating rod, and a stationary valve unit disposed at the second end of the riser, adjacent the piston valve unit and operable to remain in a substantially fixed position relative to the riser during movement of the piston valve unit, comprising:

the riser being a continuous flexible pipe formed of a material capable of being coiled prior to installation, and then when installed in an elongated generally vertical orientation, capable of forming an essentially straight section with essentially no coil memory so as to substantially avoid any wear by the movement of the unitary actuating rod therewithin; and wherein the piston valve unit has an outer diameter that is greater than an inner diameter of the riser.

2. The device of claim 1, wherein the flexible actuating rod, prior to installation, is interfitted within the riser and jointly coilable therewith.

3. The device of claim 1, wherein the material for forming the riser is an HDPE material.

4. The device of claim 1, wherein the outer diameter of the piston valve unit is approximately 4% to 144% greater than the inner diameter of the riser.

5. The device of claim 1, wherein the outer diameter of the piston valve unit is within the range from approximately 1" to approximately 3".

6. The device of claim 1, wherein the inner diameter of the riser is within the range from approximately 1" to approximately 3".

7. The device of claim 2, wherein respective ends of the interfitted actuating rod and riser are adapted to be selectively connectable to an adaptor length of interfitted actuating rod and riser device, to thereby form the overall length of flexible riser device and flexible actuating rod as needed for a given installation.

8. The device of claim 1, having a separate adaptor section formed of lengths of risers and actuating rods for connection to the respective ends of the risers and actuating rods, to form the final overall length of riser and actuating rod needed for a given well depth.

9. The device of claim 1, wherein the actuating rod is at least as long as the riser.

10. The device of claim 1, wherein the liquid discharge rate provided by pumping device is from approximately 10% to 510% greater than the peak liquid discharge through the pump foot valve cylinder, when the outer diameter of the piston device is from approximately 4% to approximately 144% greater than the inner diameter of the riser.

11. A top head drive positive displacement piston pump assembly for elevating liquids in a well, comprising:

a drive motor;

a discharge tee;

a well head;

a combination of a flexible drive rod interfitted within a flexible riser pipe, as mounted at the respective second end thereof to the drive motor and well head, the prethreaded combination capable of being jointly coilable for shipment and storage prior to installation, and further capable at installation of being jointly uncoiled and extended in a substantially straight length into a well, with the flexible riser pipe once straightened having essentially no residual spiraling caused by coil memory; and a pump foot valve cylinder assembly mounted at a first end of the interfitted combination of flexible drive rod and flexible riser pipe, the pump foot valve cylinder assembly including a cylinder, a stationary valve unit mounted in the cylinder and operable to remain stationary therewith during movement of a piston, and a reciprocal piston valve unit slidably operable within the cylinder, wherein the outer diameter of the pump foot valve cylinder assembly is greater than the inner diameter of the flexible riser pipe, thereby preventing at least the piston valve unit from being capable of being withdrawn through the flexible riser pipe for maintenance or replacement.

12. The assembly of claim 11, wherein the flexible riser pipe is formed of HDPE material.

13. The assembly of claim 11, wherein the length of the flexible drive rod is at least as long as the flexible riser pipe.

14. A method of maximizing pump flow rate of a pump foot valve cylinder assembly as connected by a riser and an actuating rod to a top head drive positive displacement piston pump assembly, for elevating liquids in a well, comprising the steps of:

arranging the riser as a continuous riser formed of a coilable material capable, when uncoiled and installed for use in a well, to operatively extend into a substantially straight orientation with essentially no coil memory so as to cause essentially no residual spiral shape, thereby substantially eliminating any contact wear of the interfitted reciprocating actuating rod within the continuous riser; and attaching a pump foot valve cylinder assembly to the continuous riser, wherein the pump foot valve cylinder assembly has a diameter that is greater than the diameter of the continuous riser.

15. The method of claim 14, wherein the outer diameter of the pump foot valve cylinder assembly is from approximately 4% to approximately 144% greater than the inner diameter of the continuous riser.

16. The method of claim 14, wherein the outer diameter of the pump foot valve cylinder assembly is greater than 1", and the inner diameter of the continuous riser is approximately 3" or less.

17. The method of claim 15, wherein the outer diameter of the pump foot valve cylinder assembly is greater than 1".

18. The method of claim 14, wherein the coilable material for forming the continuous riser member is an HDPE material.

19. The method of claim 14, wherein the average liquid discharge flow rate created is within the range form approximately 0.1 to approximately 10 gallons per minute.

* * * * *